US011724274B2

(12) United States Patent
Koebsch et al.

(10) Patent No.: US 11,724,274 B2
(45) Date of Patent: Aug. 15, 2023

(54) MOBILE PLATFORM AND OSCILLATING MECHANISM FOR COATING FLAT SURFACES

(71) Applicants: PETROLEO BRASILEIRO S.A.—PETROBRAS, Rio de Janeiro (BR); SERVICO NACIONAL DE APRENDIZAGEM INDUSTRIAL—DEPARTAMENTO REGIONAL DE SANTA CATARINA, Florianopolis (BR)

(72) Inventors: Andre Koebsch, Rio de Janeiro (BR); Andre Marcon Zanatta, Joinville (BR); Ariel Paulo Rezende, Joinville (BR); Ismael Jose Secco, Joinville (BR); Walter Kapp, Curitiba (BR)

(73) Assignees: PETROLEO BRASILEIRO S.A.—PETROBRAS; SERVICO NACIONAL DE APRENDIZAGEM INDUSTRIAL—DEPARTMENTO REGIONAL DE SANTA CATARINA

( * ) Notice: Subject to any disclaimer, the term of this patent is extended or adjusted under 35 U.S.C. 154(b) by 247 days.

(21) Appl. No.: 17/418,497

(22) PCT Filed: Dec. 26, 2019

(86) PCT No.: PCT/BR2019/050566
§ 371 (c)(1),
(2) Date: Jun. 25, 2021

(87) PCT Pub. No.: WO2020/132735
PCT Pub. Date: Jul. 2, 2020

(65) Prior Publication Data

US 2022/0097091 A1 Mar. 31, 2022

(30) Foreign Application Priority Data

Dec. 28, 2018 (BR) ..... 102018077376-3

(51) Int. Cl.
*B05B 13/04* (2006.01)
*B05B 15/62* (2018.01)
*B63B 59/00* (2006.01)

(52) U.S. Cl.
CPC ..... *B05B 13/0405* (2013.01); *B05B 15/62* (2018.02); *B63B 59/00* (2013.01)

(58) Field of Classification Search
None
See application file for complete search history.

(56) References Cited

U.S. PATENT DOCUMENTS

| | | | |
|---|---|---|---|
| 2,104,062 | A | 1/1938 | Temple |
| 5,901,720 | A | 5/1999 | Lange |
| 6,000,484 | A | 12/1999 | Zoretich |

FOREIGN PATENT DOCUMENTS

| | | | |
|---|---|---|---|
| WO | 9109770 | A1 | 7/1991 |

OTHER PUBLICATIONS

English translation of International Search Report.*

(Continued)

*Primary Examiner* — Charles Capozzi
(74) *Attorney, Agent, or Firm* — Raphael Bellum PLLC

(57) ABSTRACT

The present invention refers to a working assembly for a painting system, containing a mobile platform and a crank and slider-type oscillating mechanism, which reproduces movements transmitted to a shaft and that guides a paint gun, mimicking the process performed by painters. Thus, the mobile platform and the oscillating mechanism were designed to move unidirectionally over the surface, being able to move in two orthogonal directions and also to rotate in order to keep the platform level.

6 Claims, 4 Drawing Sheets

(56) References Cited

OTHER PUBLICATIONS

English Translation of International Search Report for International Application No. PCT/BR2019/050566, dated Mar. 3, 2020.

* cited by examiner

MOBILE PLATFORM AND OSCILLATING MECHANISM FOR COATING FLAT SURFACES

FIELD OF THE INVENTION

The present invention refers to technologies for ship and oil platform equipment, in addition to building maintenance. More specifically, the present invention refers to robot-automated painting technology.

BACKGROUND OF THE INVENTION

Large vertical flat surfaces are currently maintained or inspected by building access, such as using climbing harnesses or scaffolding. In order to paint, an employee must be able to access the location to be painted.

In shipbuilding, access is by scaffolding, as the work is done in dry dock. This access is financially expensive and time-consuming. Furthermore, it involves work safety risks.

To inspect or paint large areas, various technologies for movement may be employed, such as carts with magnetic wheels, paddle systems with suction cups, and rail installation in parts, among other solutions. These solutions are time-consuming and ineffective when using a painting system.

There is a need to reproduce the type of painting done by an employee. This means that there are certain variables in performing the work that must be considered. One of these is the linear manner in which the painting system applies paint. The movement of an employee that is considered to be the most effective is usually rectilinear (horizontal or vertical), stopping application at the ends. Since the speed in the inversion of movement is zero at these endpoints, the painting system could overspray. To prevent overspray, the mechanism of the paint application gun is stopped until it returns to its normal application speed.

Thus, the principle employed in the present invention uses a crank and slider-type oscillating mechanism capable of covering 1.4 m/s for cross painting and for 45°. This mechanism is synchronized by belts and balanced with counterweights and an inertia flywheel in counter rotation with the direction of rotation inverted by an epicyclic differential, causing the main movement involved in the painting process to reduce moments of acceleration in the speed variation of the mobile platform.

Thus, the proposed mobile platform and oscillating mechanism assembly will be based on triangular positioning of cables, operated from winders. This is a system in which the cables activate the mobile platform, which is suspended only by traction, remaining taut by its own weight plus the work load of the assembly. We believe this is an economical and extremely fast (speedy) solution for a positioning system with large vertical flat areas to be covered, in addition to being modular and transportable to the deck of a ship under construction or in operation.

The mechanism has flat movements, with a total of 3 degrees of freedom: x, y (linear) and one more degree for angular leveling adjustments. To a lesser degree there is unevenness and crossover of parts on the side.

The assembly uses 2 fixed pivots (cranes), in this case at deck height, which is the base of the suspending structure and the movement of the mobile platform. There are four mobile pivots at the ends of the mobile platform to which the movement cables are connected, and these are connected to the fixed pivots. The mobile platform will carry an oscillating painting arm, with a sweep dynamic suitable for the painting process. This assembly, mobile platform, and oscillating mechanism are what carry out the painting system's application process.

This system may apply paint by automated painting or by thermal spray metallization.

The strategy used in the painting process is to descend without painting and to ascend painting, such that the main obstacles will be faced in the process, as if descending stairs. Shifting to a lateral strip will occur at the top of the hull when the ropes are very taut, and the momentum will therefore be tightly controlled. There is no interference from obstacles in carrying out the painting. The movement of the mobile platform is independent of obstacles. The movement is mainly related to not crossing over a newly painted region. The system was developed to overcome obstacles without interfering with the painting.

In addition to the oil and gas industry, this technology may be used in civil construction.

As will be further detailed below, the present invention aims to resolve the problems in the prior art described above in a practical and efficient manner.

SUMMARY OF THE INVENTION

The purpose of the present invention is to apply paint on the hull of ships and platforms in an automated manner.

In order to achieve the objective described above, the present invention provides a crank and slider-type oscillating mechanism, which produces movements transmitted to a rod and that guides a paint gun.

Thus, the mobile platform and the oscillating mechanism were designed to move unidirectionally over the surface, and are able to move in two orthogonal directions and also to rotate in order to keep the platform level.

BRIEF DESCRIPTION OF THE FIGURES

The detailed description presented below references the attached figures and their respective reference numbers.

DETAILED DESCRIPTION OF THE INVENTION

First, it should be noted that the following description will start from a preferred embodiment of the invention. As will be apparent to anyone skilled in the art, however, the invention is not limited to that particular embodiment.

Figure 1:
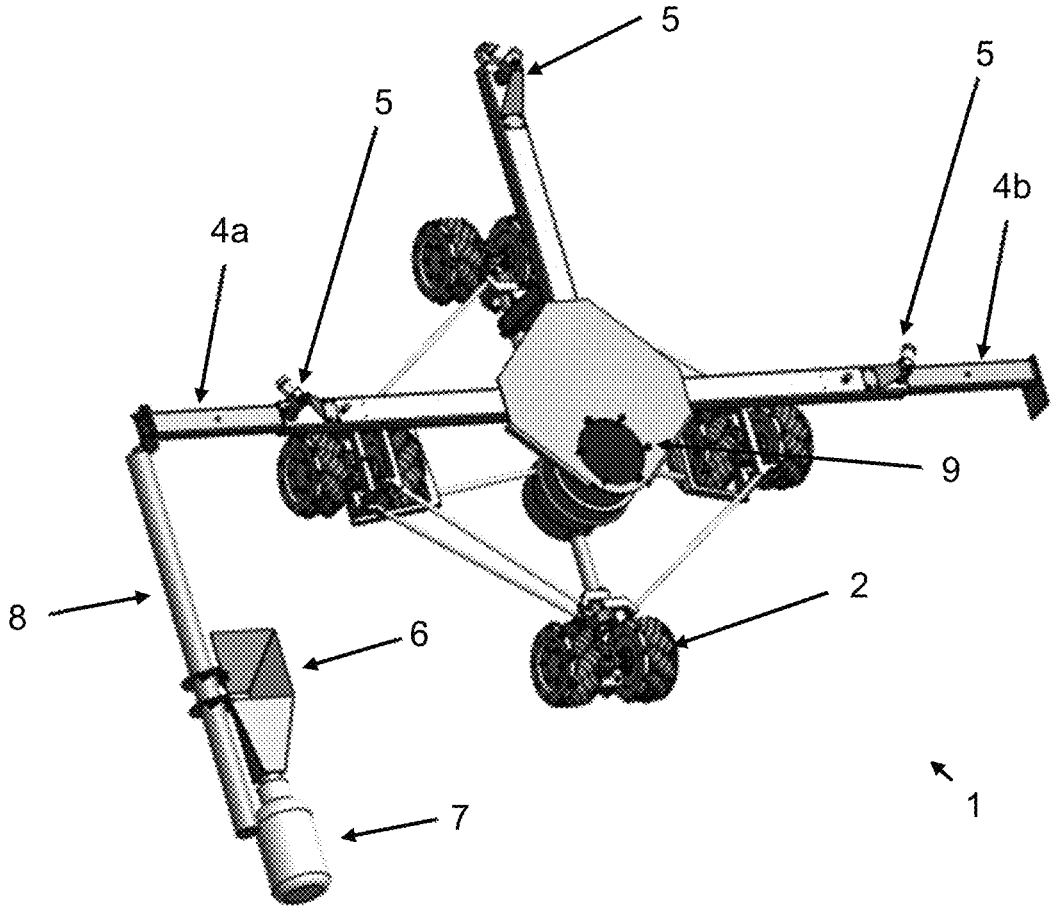
FIG. 1 illustrates the mobile platform with the Mecanum wheel suspension system.

FIG. 1 illustrates the mobile platform (1) including the Mecanum wheels (2) installed. The platform has 4 attaching pivots (5) for the cables that are necessary to move the system. The platform contains two adjustable arms (4), normally used to support the counterweight (8) of the cables and the cable carrier (not shown in the figure).

The arm (4*a*), shown in FIG. 1, receives the counterweight (8) with the purpose of balancing the mobile platform when connected to the cable carrier that is connected to the arm (4*b*). The counterweight (8) can serve as support for the purge sink (6) and the purge tank (7). The cable carrier supports the cables that connect the airless paint pump to the spray gun (11).

The part shown in (9) is a flanged connection for engaging and securing the oscillating mechanism. In it there is a cylindrical and empty space (10) to receive and house the electric motor (15).

Figure 2:
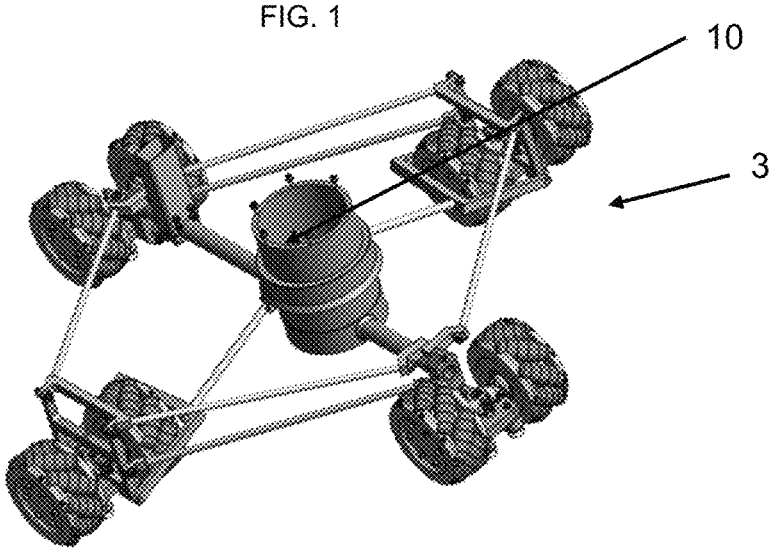
FIG. 2 shows the configuration of the wheel supports that are inserted into and secured to the mobile platform.
Figure 3:
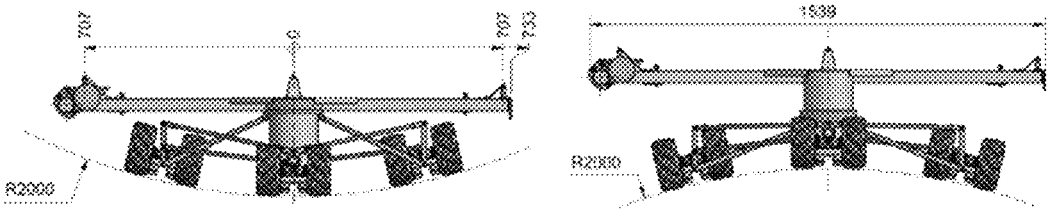
FIG. 3 illustrates the adaptation of the Mecanum wheel suspension system to different surface curvatures.

FIG. 2 illustrates the support of the Mecanum wheels (3). The support was built so that two of the four wheels are centered on the central axis of the platform and the other two are located on the sides. The side wheel supports use suspended shafts that are capable of flexing based on the angulation of the part or hull, keeping the wheels aligned with the surface. FIG. 3 illustrates two possible types of curvature in a painting surface.

In general, the platform is intended to restrict movement against the plane of the side, allowing parallel movements that are controlled by the cables.

Figure 4:
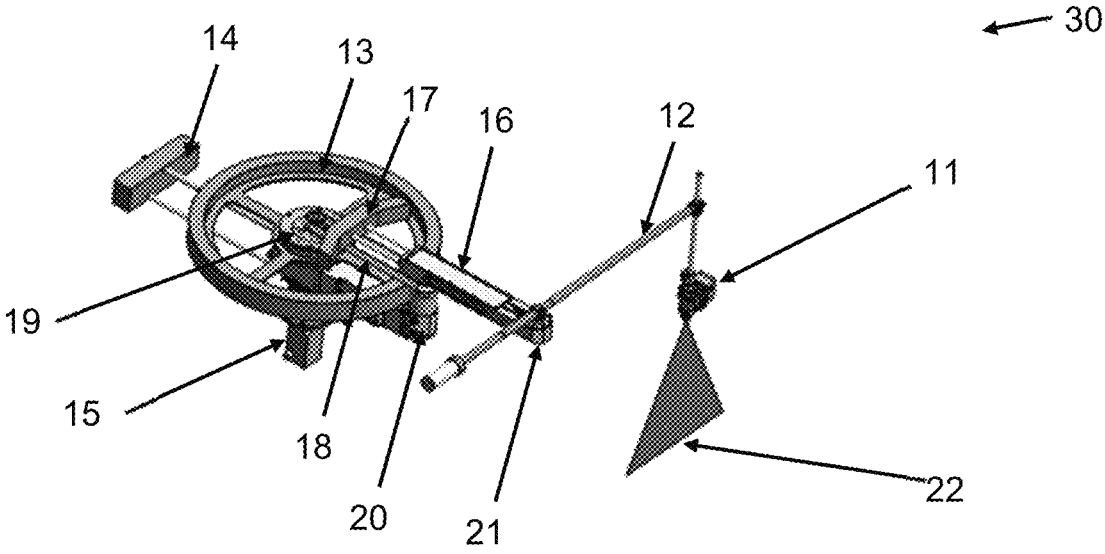
FIG. 4 illustrates a schematic view of the oscillating mechanism with the paint rod.
Figure 5:
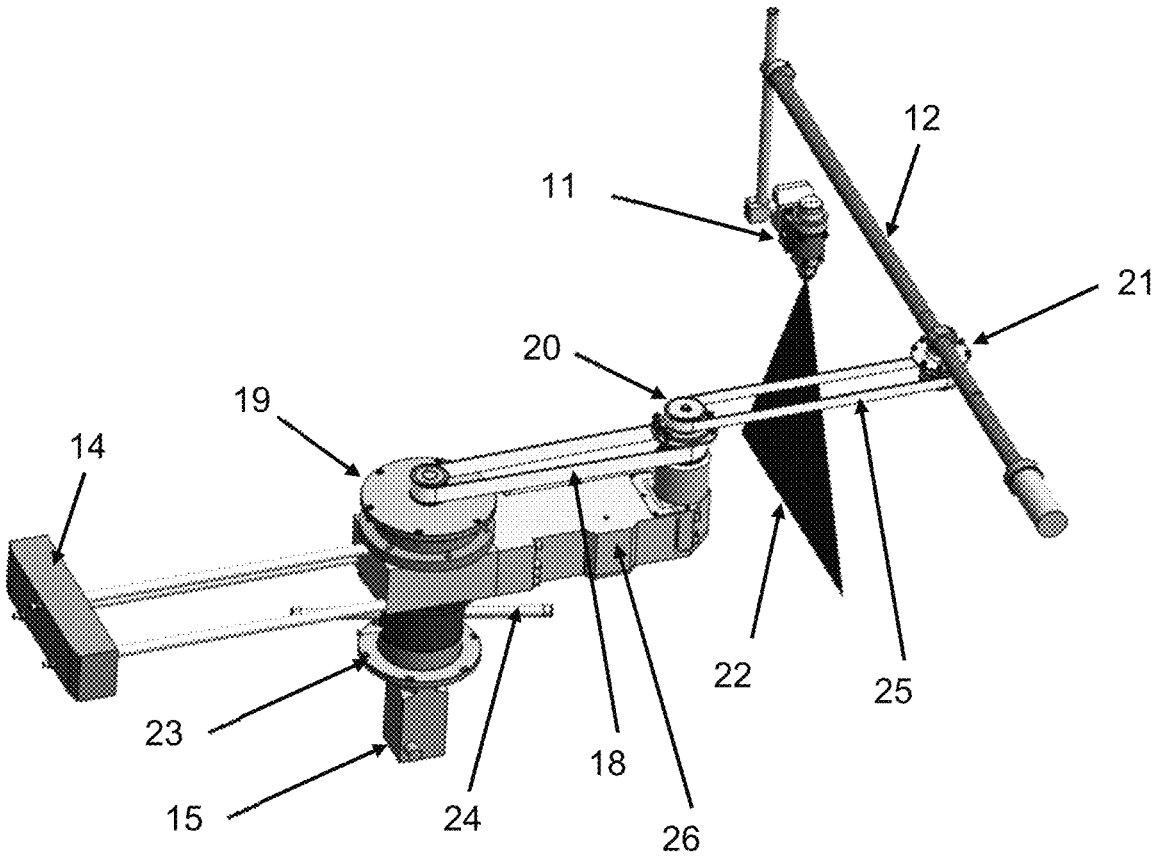
FIG. 5 details the transmissions between the oscillating mechanism's pulleys.

FIG. 4 and FIG. 5 illustrate the mechanism used as an oscillating system for the painting arm without inversion where the rotating movement will be called crank and slider-type, because the inversion of the alternative movement is mechanical, as in the pistons of an internal combustion engine. The electric motor (15) remains in a position in the center of the mobile platform inside a compartment (10) in the pedestal (19) of the oscillating mechanism (29). The arm (26) and the forearm (16) are interconnected by a pivot (20) that contains two toothed pulleys, one with 36 teeth connected by the inertia coupling belt (18) and the other with 30 teeth coupled to the forearm (16) and interconnected by the belt (25).

The rod (12) is connected to the forearm (16) by a toothed pulley with 30 teeth (21). At one end is the paint gun (11), which is fed by an airless paint pump. The paint array shows the actual paint line (22) on the surface.

This mechanism now has an inertia flywheel (13) with a larger diameter of 661 mm not restricted to that size, which will make it more effective even with a smaller mass. Due to the mechanism's self-colliding limitations, the diameter of the inertia flywheel (13) is limited and can no longer be increased, even using lead as the material.

The arm (14) and forearm (17) counterweights could also be mounted with the maximum distance allowed, and also have their mass reduced.

The motor is attached to the pedestal by a flanged connection (23) and is hidden in the compartment (10) of the mobile platform.

The course of the pedestal (19) is corrected through the lever (24) allowing cross oscillations at 45°.

The inertia coupling belt (18) is stiffer to provide better coupling with the inertia flywheel (13) than with the pedestal (19).

Figure 6:
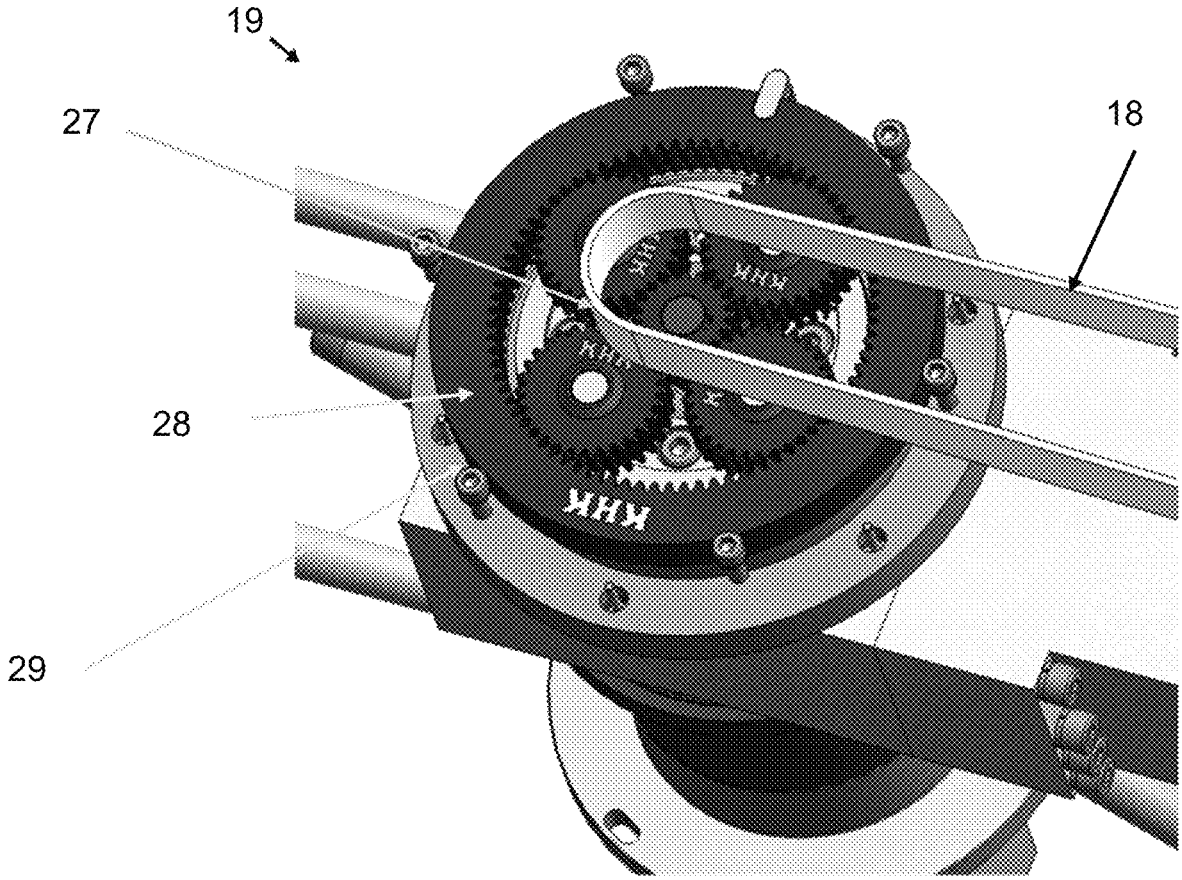
FIG. 6 illustrates the semi-open pedestal with a detail of the gears that interconnect the inertia flywheel and the inertia coupling belt.

FIG. 6 shows the internal structure of transmission from the pedestal shaft to the flywheel (13) and the inertia coupling belt (18). Inside the annular of the epicyclic (29), there are 4 gears (28), enveloping the sun of the epicyclic (27).

Figure 7:
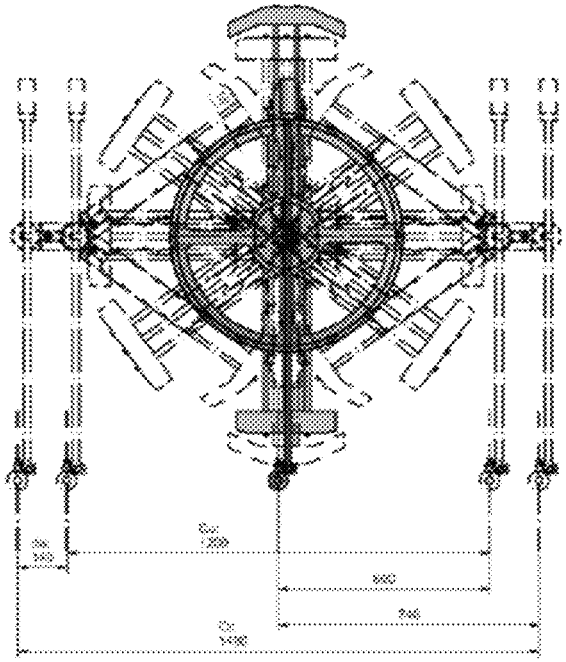
FIG. 7 illustrates the movement of the oscillating mechanism and the course of the paint rod.

FIG. 7 shows the movement positions of the oscillating system in just one illustration, highlighting the linear movement of the pistol shaft. The total course of the arm (12) is 1,480 mm (end to end), with an acceleration distance of 140 mm at each end and a useful course of 1,200 mm in the center.

The invention claimed is:

1. A mobile platform and oscillating mechanism for coating flat surfaces, the platform comprising:
- four movable pivots,
- two adjustable arms,
- a platform counterweight,
- a suspension system of mecanum wheels and a compartment; and the oscillating mechanism, comprising:
- a flywheel,
- an arm and a forearm with an arm counterweight and a forearm counterweight, respectively
- a shaft,
- a paint gun,
- a pedestal, comprising:
  - an electric motor,
  - a flanged connection,
  - a lever,
  - an annular of an epicyclic gear train,
  - four gears and an epicyclic sun,
- a first oscillating mechanism pivot located on the arm comprising two toothed pulleys, and connecting an inertia coupling belt with a forearm belt, and
- a second oscillating mechanism pivot located on the forearm, comprising a toothed pulley that interconnects the shaft with the forearm belt.

2. The mobile platform and oscillating mechanism of claim 1, wherein one of the two adjustable arms receives the platform counterweight that supports a purge sink and a purge reservoir.

3. The mobile platform and oscillating mechanism of claim 1, wherein the pedestal is an integral part of the oscillating mechanism.

4. The mobile platform and oscillating mechanism of claim 1, wherein one of the two adjustable arms receives a cable carrier.

5. The mobile platform and oscillating mechanism of claim 1, wherein the forearm with the forearm counterweight contains the forearm belt.

6. The mobile platform and oscillating mechanism of claim 1, wherein the arm with the arm counterweight is located on an axis of the pedestal.

* * * * *